US007748183B2

(12) United States Patent
Myers et al.

(10) Patent No.: US 7,748,183 B2
(45) Date of Patent: Jul. 6, 2010

(54) SYSTEM, METHODS AND COMPOSITIONS FOR ATTACHING PANELING TO A BUILDING SURFACE

(75) Inventors: Jeffrey D. Myers, Boulder, CO (US); Scott Thomas, Boulder, CO (US)

(73) Assignee: Composite Foam Material Technology, LLC, Boulder, CO (US)

( * ) Notice: Subject to any disclaimer, the term of this patent is extended or adjusted under 35 U.S.C. 154(b) by 285 days.

(21) Appl. No.: 11/268,425

(22) Filed: Nov. 7, 2005

(65) Prior Publication Data

US 2006/0123729 A1 Jun. 15, 2006

Related U.S. Application Data

(60) Provisional application No. 60/631,647, filed on Nov. 30, 2004, provisional application No. 60/626,149, filed on Nov. 9, 2004.

(51) Int. Cl.
*E04B 1/70* (2006.01)
*B44F 7/00* (2006.01)

(52) U.S. Cl. ..... 52/302.1; 52/302.3; 52/539; 52/314

(58) Field of Classification Search ..... 52/519, 52/520, 521, 536, 539, 302.3, 314, 591.4, 52/302.1, 302.7, 533, 558; 428/44, 60
See application file for complete search history.

(56) References Cited

U.S. PATENT DOCUMENTS 774,740 A * 11/1904 Darnall ..... 52/529
1,386,554 A * 8/1921 Dalglish ..... 52/591.4
1,427,968 A * 9/1922 Pedersen ..... 52/538
1,986,739 A * 1/1935 Mitte ..... 52/591.4
2,005,462 A * 6/1935 Gibson ..... 52/276
2,039,536 A * 5/1936 Johnson ..... 52/314
2,058,578 A * 10/1936 Eckert ..... 52/554
2,063,935 A * 12/1936 Kirschbraun ..... 52/314
2,122,577 A * 7/1938 Mattes et al. ..... 52/314
2,221,475 A * 11/1940 Goldschmidt, Sr. ..... 52/314
2,224,351 A * 12/1940 Kaye ..... 52/314
2,246,377 A * 6/1941 Mattes ..... 52/314
2,270,808 A * 1/1942 Kaye ..... 52/314

(Continued)

OTHER PUBLICATIONS

NextStone Is it Real Rock or is it Nextstone? brochure, Jan. 2005.

*Primary Examiner*—Robert J Canfield
*Assistant Examiner*—Brent W Herring
(74) *Attorney, Agent, or Firm*—Faegre & Benson LLP

(57) ABSTRACT

The present disclosure concerns a system, methods and compositions for attaching architectural panels to a building surface, such as a wall. In certain embodiments, the system comprises panels, each with upper, lower and side interlocking members. In a preferred embodiment, the upper and lower interlocking members form a modified tongue and groove joint, with a 45 degree angle interface, while the side interlocking members form a ship lap joint. The upper and lower interlocking members may be designed to press the panels against the building surface and to hide the locations of screws or other attachment devices when the interlocking members are engaged. The system provides a stronger and more secure attachment of panels to a building surface, while eliminating the problem of having to disguise the location of the attachment devices where such devices are inserted directly through the surface of the panel.

21 Claims, 5 Drawing Sheets

100

U.S. PATENT DOCUMENTS 2,278,289 A * 3/1942 Snyder ..... 52/314
RE22,481 E * 5/1944 Kaye ..... 52/314
2,624,298 A * 1/1953 Farren ..... 52/533
2,660,217 A * 11/1953 Lawson ..... 156/212
2,724,872 A * 11/1955 Herbes ..... 52/553
3,204,380 A * 9/1965 Wilson et al. ..... 52/309.15
3,217,453 A * 11/1965 Medow ..... 52/314
3,284,967 A * 11/1966 Elliott et. al. ..... 52/58
3,507,079 A * 4/1970 George ..... 52/74
3,613,326 A * 10/1971 Mollman ..... 52/314
3,686,813 A * 8/1972 Breitwieser et al. ..... 52/302.3
3,771,271 A * 11/1973 Keel ..... 52/478
3,807,113 A * 4/1974 Turner ..... 52/314
3,908,326 A * 9/1975 Francis ..... 52/384
4,100,710 A 7/1978 Kowallik
4,164,832 A 8/1979 Van Zandt
4,223,490 A * 9/1980 Medow ..... 52/98
4,242,390 A * 12/1980 Nemeth ..... 428/47
4,279,106 A * 7/1981 Gleason et al. ..... 52/100
4,432,183 A * 2/1984 Pike et al. ..... 52/533
4,454,863 A * 6/1984 Brown et al. ..... 126/669
4,899,514 A * 2/1990 Brookhart, Jr. ..... 52/553
4,914,885 A * 4/1990 Baker et al. ..... 52/520
5,029,425 A 7/1991 Bogataj
5,040,348 A * 8/1991 King et al. ..... 52/533
5,165,816 A 11/1992 Parasin
5,166,230 A 11/1992 Stecker
5,295,339 A * 3/1994 Manner ..... 52/518
5,347,784 A * 9/1994 Crick et al. ..... 52/520
5,519,975 A * 5/1996 Taylor et al. ..... 52/533
5,537,792 A * 7/1996 Moliere ..... 52/531
5,581,968 A * 12/1996 Laurie et al. ..... 52/538
5,613,337 A * 3/1997 Plath et al. ..... 52/533
5,618,602 A * 4/1997 Nelson ..... 428/60
5,711,126 A * 1/1998 Wells ..... 52/519
5,836,123 A * 11/1998 Gulino ..... 52/288.1
5,928,764 A * 7/1999 Costi ..... 428/182
5,956,910 A * 9/1999 Sommerstein et al. ..... 52/235
6,282,858 B1 * 9/2001 Swick ..... 52/533
6,449,915 B1 * 9/2002 Park ..... 52/407.1
6,510,665 B2 * 1/2003 Pervan ..... 52/589.1
6,530,189 B2 * 3/2003 Freshwater et al. ..... 52/553
6,599,452 B1 7/2003 Ferguson
6,607,683 B1 8/2003 Harrington
6,634,617 B2 10/2003 Potvin
6,675,544 B1 1/2004 Ou et al.
6,747,075 B2 6/2004 Nardi et al.
6,823,633 B2 * 11/2004 Ryan ..... 52/302.1
7,127,869 B2 * 10/2006 Perry ..... 52/747.1
7,235,204 B2 6/2007 Harrington
7,240,461 B1 * 7/2007 Vandeman et al. ..... 52/539
7,306,757 B2 12/2007 Harrington
7,524,555 B2 4/2009 Peng et al.
2002/0078651 A1 * 6/2002 Freshwater et al. ..... 52/553
2002/0189188 A1 * 12/2002 Iole et al. ..... 52/536
2003/0046888 A1 * 3/2003 Ryan ..... 52/302.1
2003/0046891 A1 * 3/2003 Colada et al. ..... 52/518
2003/0115812 A1 * 6/2003 Pervan ..... 52/283
2004/0031222 A1 * 2/2004 Porat ..... 52/302.1
2004/0159062 A1 * 8/2004 Donlin et al. ..... 52/506.01
2005/0081468 A1 * 4/2005 Wilson et al. ..... 52/528
2007/0175154 A1 * 8/2007 Wilson et al. ..... 52/521
2007/0193177 A1 * 8/2007 Wilson et al. ..... 52/518
2009/0007517 A1 * 1/2009 Swanson ..... 52/543

* cited by examiner

100

SYSTEM, METHODS AND COMPOSITIONS FOR ATTACHING PANELING TO A BUILDING SURFACE

RELATED APPLICATIONS

The present application claims the benefit under 35 U.S.C. §119(e) of Provisional U.S. Patent Application Ser. No. 60/631,647, entitled "Composite Panels for Attachment to a Building Surface," filed Nov. 30, 2004, and Provisional U.S. Patent Application Ser. No. 60/626,149, entitled "System, Methods and Compositions for Attaching Paneling to a Building Surface," filed Nov. 9, 2004, the entire contents of each of which are incorporated herein by reference.

FIELD

The present invention relates to a system, methods and compositions for attaching paneling to a building surface, for example an interior or exterior wall. In a particular embodiment, the system comprises panels that have one or more interlocking members. The interlocking members may be designed to allow the panels to be attached to a wall or other building surface while concealing the attachment sites from view and/or eliminating the need for caulking to hid fasteners. The interlocking members may be designed so that the panels are pressed against the wall or other building surface when the interlocking members are engaged. In certain embodiments, the panels may be shaped and textured to resemble a different building material, such as rock, brick, wood, stucco or slate. In other embodiments, the panels may comprise a composite of two or more different types of plastic or other materials.

BACKGROUND

Various types of simulated building materials have been used to enhance the appearance of the surfaces of buildings. Traditional building materials, such as stone, brick, stucco, slate or wood may be expensive, time consuming and labor intensive to obtain, transport to a building site, shape, assemble and otherwise work with. While synthetic, composite or other replacement materials may be less expensive, easier to work with and/or more lightweight, their appearance may be considered to be aesthetically inferior to natural building materials. Thus, a need exists for building materials that mimic the appearance of stone, brick, wood, etc. while maintaining the advantages of the substitute materials.

Methods and compositions for producing materials that simulate stone, brick, wood or other materials have been reported. For example, U.S. Pat. No. 6,747,075 discloses methods and compositions for producing a simulated limestone prepared from polyester resin, alumina, microspheres, sand and pigment. U.S. Pat. No. 5,166,230 discloses methods for producing synthetic materials simulating marble, granite or other stone, using a thermosetting resin. U.S. Pat. No. 6,599,452 discloses methods for making simulated stone or wood architectural items from mineral fiber-reinforced hybrid polyurethane. U.S. Pat. No. 6,634,617 discloses a system to produce simulated stone or rock from cementitious material. Each of the patents listed above is incorporated herein by reference in its entirety.

Such simulated materials may be incorporated, for example, into architectural panels that may be attached to the surfaces of interior or exterior walls or other building surfaces, including but not limited to doors, roofs, porches, fireplace surrounds, skirting, or other architectural or structural elements. Such panels may be used to enhance the appearance of a building, by simulating a stone, brick, stucco or other type of building surface. However, the appearance of a different building material is negated if the attachment sites are exposed. Such panels may be attached to a surface using, for example, screws, nails, anchors, or other attachment devices. The easiest way to attach a panel to a surface would be, for example, to place a screw, nail or other attachment device through the panel into the surface. However, the head of the screw or nail would remain visible from the exterior surface of the panel. Since screws, nails and similar attachment devices are generally not used to attach real brick or stone to a building surface, the visibility of the attachment device would destroy the illusion of a simulated building material.

Thus, to maintain the appearance of a real stone, brick or other surface, the screw or nail heads need to be sunk below the surface level of the panel and covered with grout, spackle, foam or another material that is colored and textured to resemble the rest of the panel. This may be feasible where the panels are uniformly colored and textured. However, certain types of simulated building materials, such as simulated stone blocks, vary in color across a panel. Trying to obtain an exact color match for each attachment site is a difficult and time-consuming process. Thus, a need exists for simulated building materials that may be attached to a wall or other building surface in such a way that the attachment sites are hidden from view, eliminating the need for exact color matching to hide the attachment sites. A need also exists for an architectural panel design with interlocking members that press the panel against the wall or other building surface when the interlocking members are engaged between adjacent panels. Such a design would provide increased stability and strength to the interlocked panels and reduce panel failure and/or detachment, for example in high wind conditions.

SUMMARY

The present invention provides a system, methods and compositions for attaching paneling to walls or other building surfaces. In particular embodiments, the paneling may be shaped and textured to resemble a different building material, such as rock, brick, wood, stucco or slate. The skilled artisan will realize that there are many different materials and methods that may be used to produce panels that simulate other building materials (see, e.g., U.S. Pat. Nos. 5,166,230; 6,599,452; 6,634,617; 6,747,075), such as polyester resin, thermosetting resin, polyurethane or cementitious material and any such known materials may be used.

In a preferred embodiment, the panels may be substantially rectangular in shape, with an elongate horizontal axis compared to the vertical axis of the panel, although the artisan will realize that other shapes such as square panels or rectangular panels that are elongated in the vertical direction may be used. In the preferred, horizontally elongate embodiment, the panels may be attached to a wall or other building surface in a substantially horizontal arrangement, with interlocking members located at each edge of the panels. Each panel may therefore have an upper interlocking member, a lower interlocking member, and two side interlocking members. In an exemplary embodiment, the interlocking members on the sides of the panel may form a ship lap joint, while the upper and lower interlocking members may form a modified tongue and groove joint.

In particular embodiments, the system may comprise panels with one or more interlocking members, designed to connect one panel with the adjacent panels. Such members may include, but are not limited to, ship lap, tongue and groove or any other type of interlocking member. In a preferred embodiment, the interlocking members may be designed so that the panels are pressed against the wall or other surface to which the panel is attached when the interlocking members are engaged. In a non-limiting example, such a design may comprise upper and lower interlocking members resembling a modified tongue and groove joint, with the upper and lower edges of the modified tongue and groove forming an interlocking junction disposed at a 45 degree angle (see, e.g., FIG. 1A). When the upper interlocking member (FIG. 1A, 110) is engaged with the lower interlocking member (FIG. 1A, 120) of the next panel above, the 45 degree angle on the upper member 110 is disposed towards the wall or other building surface. Since the force of gravity acts to push the upper panel down against lower panel, the 45 degree surface on the upper interlocking member 110 of the lower panel redirects that force towards the wall or other building surface, pressing the lower edge of the upper panel against the wall. Thus, when the panel system is installed, the entire interlocked panel array is pressed against the building surface. This provides a more secure and stable attachment of the panel array to the wall or other surface. Although a contact angle between upper 110 and lower 120 interlocking members of about 45 degrees is preferred, the skilled artisan will realize that other contact angles may be utilized, for example between about 22.5 and 77.5 degrees, between about 30 and about 60 degrees, or between about 40 and 50 degrees.

BRIEF DESCRIPTION OF THE DRAWINGS

The following drawings form part of the present specification and are included to further demonstrate certain exemplary embodiments of the present invention. The embodiments may be better understood by reference to one or more of these drawings in combination with the detailed description of specific embodiments presented herein.

DESCRIPTION OF ILLUSTRATIVE EMBODIMENTS

Definitions

Terms that are not otherwise defined herein are used in accordance with their plain and ordinary meaning.

As used herein, "a" or "an" may mean one or more than one of an item.

As used herein, "about" means within plus or minus ten (10) percent of a value. For example, "about 100" refers to any number between 90 and 110.

Architectural Panels

Figure 1:
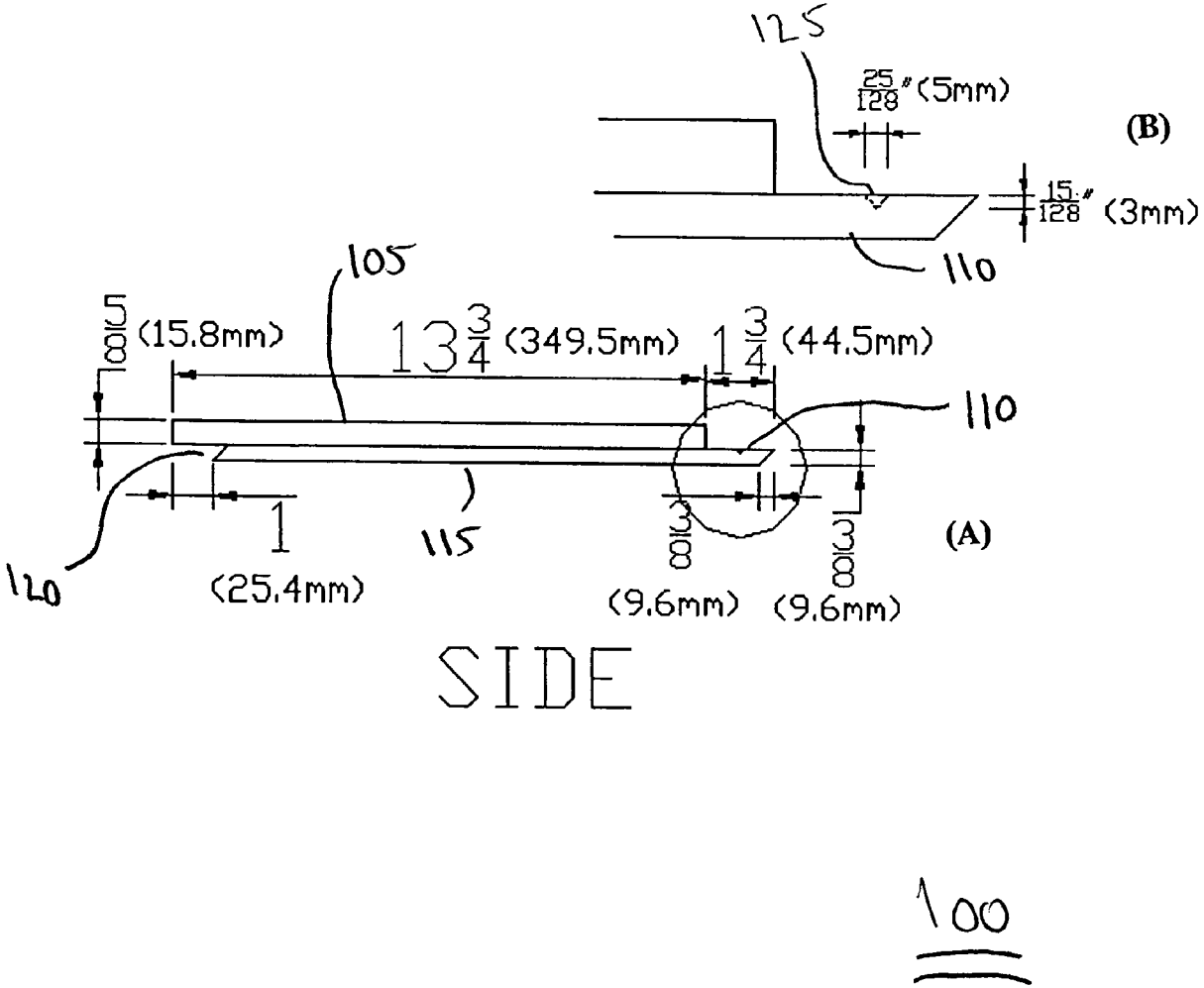
FIG. 1A illustrates a side view of an exemplary panel.
FIG. 1B illustrates an enlarged view of an upper interlocking member, showing the 45 degree angle surface.

FIG. 1A illustrates a non-limiting example of an architectural panel 100. The panel 100 comprises an exterior surface 105, that is exposed to the environment and an interior surface 115, that contacts the wall or other building surface to which the panel 100 is attached. As discussed above, the exterior surface 105 may be shaped and textured to resemble a different building material, such as simulated rock. FIG. 1A also shows an exemplary embodiment of upper 110 and lower 120 interlocking members. In this non-limiting example, the upper 110 and lower 120 interlocking members resemble a modified tongue and groove joint, or a modified ship lap joint. When the panel 100 is attached to a wall, the upper interlocking member 110 is at the top of the panel 100 and the lower interlocking member 120 is at the bottom of the panel. As the skilled artisan will appreciate, in certain embodiments the orientation of the panel 100 when assembled into a panel array may be important for the proper function of the system.

As illustrated in FIG. 1A, the upper 110 and lower 120 interlocking members may be designed with a 45 degree interface (contact angle) where the upper 110 and lower 120 interlocking members of adjacent panels 100 contact each other when the panels 100 are assembled into an array. The upper interlocking member 110 thus forms a modified tongue, while the lower interlocking member 120 forms a modified groove, to provide a modified tongue and groove joint between the upper end of one panel 100 and the lower end of an adjacent panel 100. As discussed above, when the panels 100 are assembled into a panel array, the modified tongue and groove joints act to push the panels against the wall or other building surface to which they are attached, providing a stronger, more stable and more secure attachment of the panel array to the wall.

In this non-limiting example, the dimensions of the panel 100 may be as shown in FIG. 1A. The exterior surface 105, which may be a simulated stone, brick or other surface, may be 13.75 inches from top to bottom edge. The lower interlocking member 120 or modified groove may be recessed 1.0 inch from the bottom edge of the panel 100 to the outer edge of the groove. The upper interlocking member 110 or modified tongue may be 1.75 inches from the top end of the exterior surface 105 to the distal edge of the tongue. The interior surface may be approximately ⅜ inches thick. In such exemplary embodiments, the portion of the modified tongue exhibiting a 45 degree angle would extend for ⅜ inches. When the upper 110 and lower 120 interlocking members of adjacent panels 100 are engaged, this would result in a ⅜ inch wide grout line between upper and lower panels 100, with a consistent reveal between the panels 100.

FIG. 1B shows an enlargement of the upper interlocking member 110. In some alternative embodiments, a screw attachment strip 125 may be located on the upper interlocking member 110. The screw attachment strip 125 is a groove that runs parallel to the horizontal axis of the panel 100. As indicated, in this non-limiting example the screw attachment strip 125 may be approximately 3 mm deep and 5 mm wide. The strip 126 provides a guide for screw alignment and allows the screw heads to set flush when they are screwed through the panel 100 into a wall or other building surface. As long as the screw attachment strip 125 is located more than ⅜ inches away from the upper end of the exterior surface 105, then the overlapping portion of the adjacent upper panel 100 would hide the screw heads from external view when the upper 110 and lower 120 interlocking members are engaged. In alternative embodiments, the panel 100 may contain a guide line for attachment devices, rather than a screw attachment strip 125. The guide line may comprise one or more marks on the upper interlocking member 110, for example notches or small indentations in the panel 100 surface located approximately 16 inches apart and spaced along the attachment line. In a preferred embodiment, nails, screws or other attachment devices are inserted into the panel 100 along the screw attachment strip or guide line, with one screw inserted near each end of the panel and up to three screws inserted in between the two ends of the panel 100.

Figure 2:
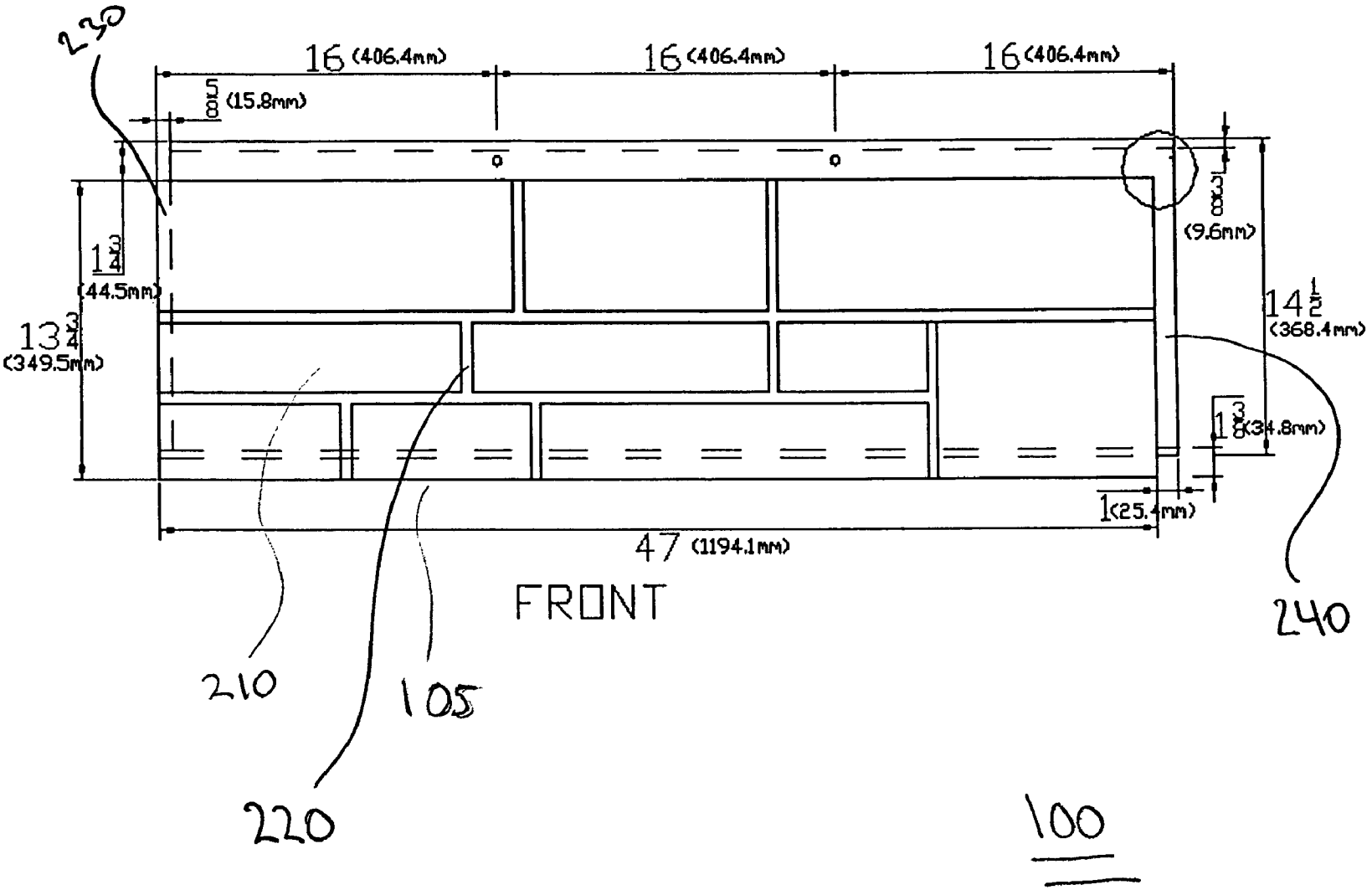
FIG. 2 illustrates a front view of an exemplary panel. The circle at the upper right hand corner shows the area enlarged in FIG. 3.

FIG. 2 illustrates a front view of an exemplary panel 100. In this non-limiting example, the exterior surface 105 is shaped and configured to resemble stone blocks, with raised areas 210 representing the simulated blocks separated by grooves 220. In this example, the entire panel 100 is 48 inches in width and 15.5 inches in height. In this exemplary embodiment, the interlocking members 230, 240 at the sides of the panel 100 form a ship lap joint, with a ⅝ inch recess 230 on one side of the panel 100 and a 1 inch extension 240 on the other side. When panels 100 are interlocked side to side, the dimensions of the ship lap joint provide a ⅜ inch wide grout line between adjacent panels. As discussed above, the dimensions of the interlocking members 110, 120, 230, 240 are designed to provide a ⅜ inch reveal on the top, bottom and each side of the panel 100 when assembled into a panel array. However, the skilled artisan will understand that the disclosed embodiments are not limiting and that the dimensions of part or all of the panel may be varied, resulting in different size reveals, grout lines, etc. In this example, the exterior surface 105 of the panel is 47 inches in width and 13.75 inches in height. A circle at the upper right corner of the panel 100 shows an area that is enlarged in FIG. 3.

Figure 3:
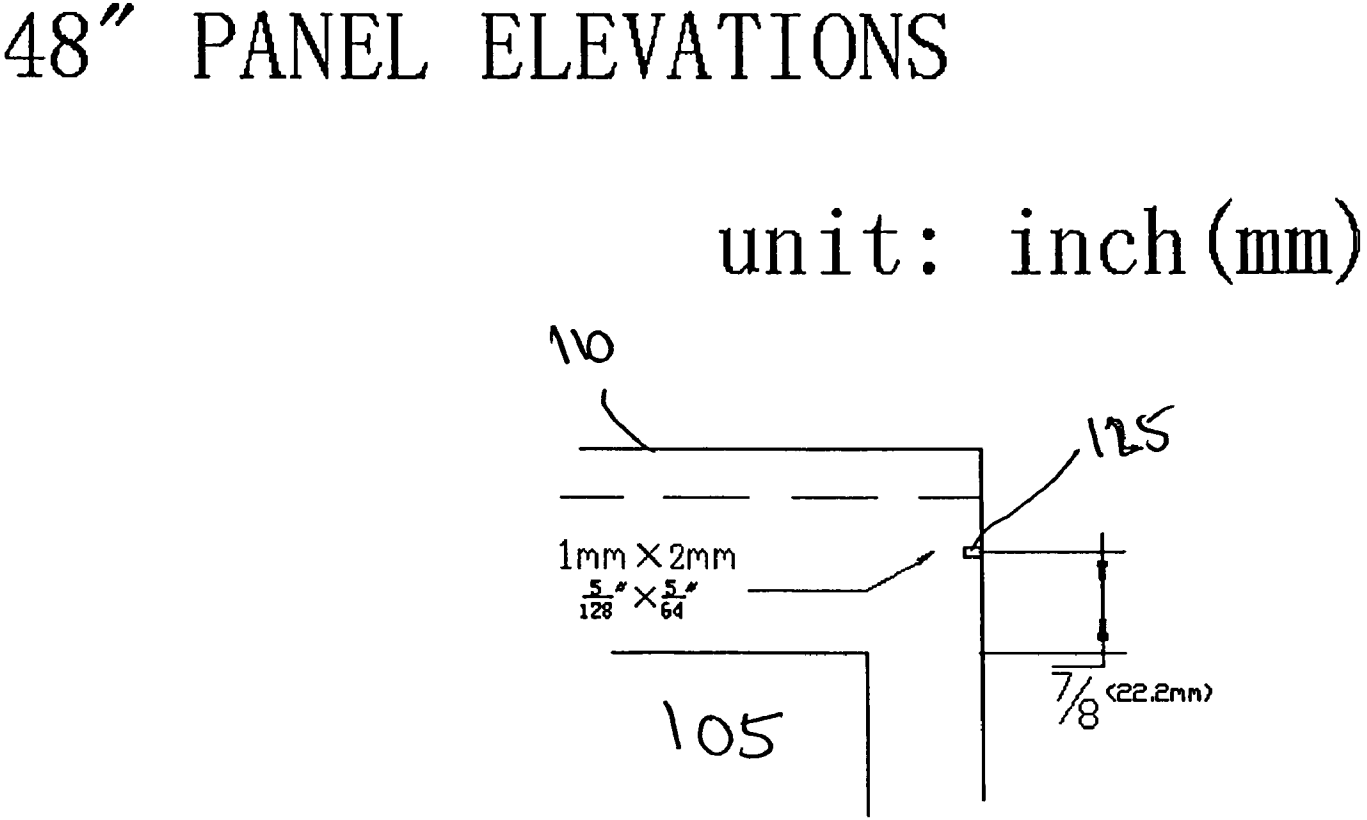
FIG. 3 shows an enlarged view of the circled area in FIG. 2.

FIG. 3 illustrates an enlarged portion of the panel 100 shown in FIG. 2. In this non-limiting example, the screw attachment strip is located in the middle of the upper interlocking member and is therefore ⅞ inches away from the upper end of the exterior surface 105.

Figure 4:
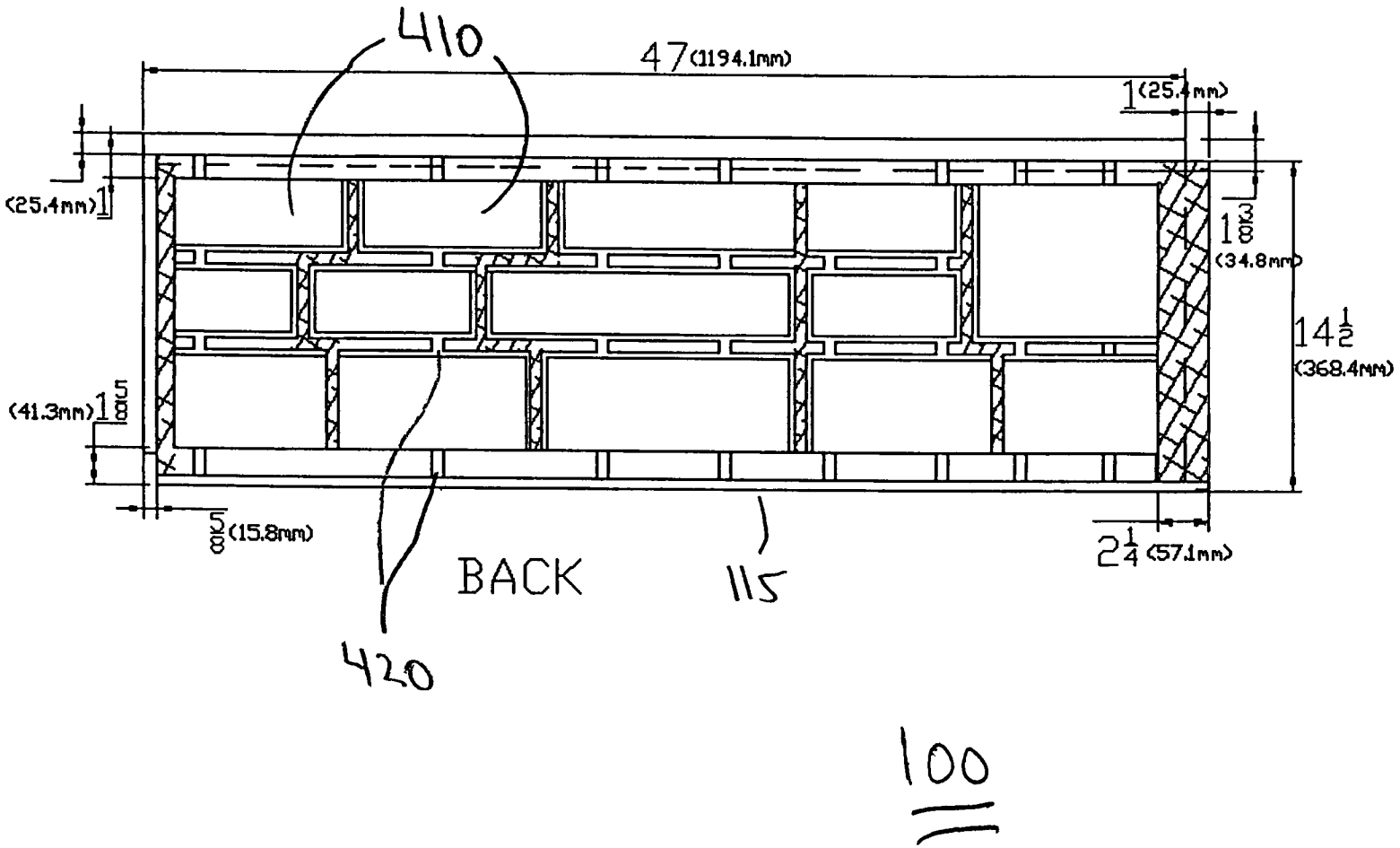
FIG. 4 shows a back view of an exemplary panel.

FIG. 4 illustrates the back view of an exemplary panel 100. The interior surface may be designed with recessed air pockets 410 and/or weep channels 420 to allow for air flow and water drainage between the panel 100 and the wall or other building surface to which the panel 100 is attached. The recessed air pockets 410 may be interconnected by the weep channels 420, which form aligned vertical grooves across the back of the panel 100. The weep channels may also be aligned between vertically adjacent panels 100, allowing continuous channels for air circulation and water drainage behind the assembled panel array. However, because the edges of the panels 100 are not sealed with adhesive, even if the weep channels are not aligned between adjacent panels, water may still drain and air may circulate. In the event that water seeps behind the panel array, for example due to insufficient or defective sealing around doors or windows or at the top of the panel array, the weep channels 420 allow the water to drain out, preventing buildup of mold, fungus or rot. In cold environments, the water drainage would also prevent structural damage caused by repeated freeze-thaw cycles. The air pockets 410 act to decrease the overall weight of the panel 100 and allow air circulation behind the panel array. This further acts to remove any water behind the panel 100 and to prevent condensation.

Figure 5:
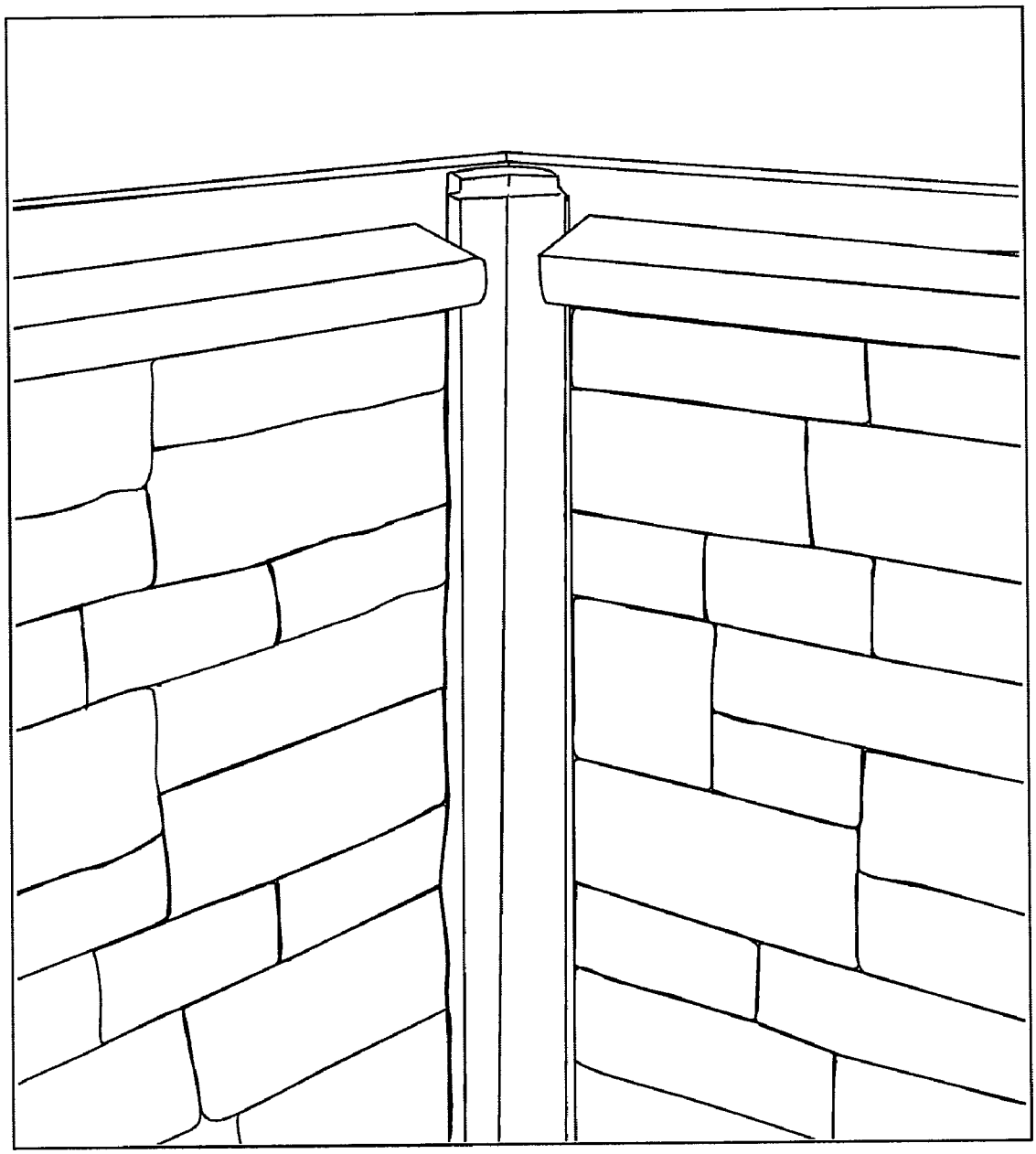
FIG. 5 shows an exemplary embodiment of a ledger (at top of simulated stone surface) and an interior corner (at junction between two simulated stone walls).

The panel array may be further installed using ledgers and corners (not shown). The ledger may be installed at the top end of the panel array, and may contain a modified, 45 degree angle groove to interlock with the upper interlocking member 110 of the top panels 100 of the panel array. The corners may be designed to interlock with the side interlocking members 230, 240 of the panel array where they meet at a building corner. FIG. 5 illustrates a non-limiting example of ledgers and an interior corner. As indicated, the corner is comprised of material that matches the color and texture of the panels, shaped into a right-angle piece of material. FIG. 5 also illustrates that the corner piece is designed to provide a ship lap joint with the panels on either side of the corner. The ledger may also be designed to provide a 45 degree angle modified groove, to form a modified tongue and groove joint with the upper interlocking member 110 of each uppermost panel 100 in the panel array.

EXAMPLES

Example 1

Exemplary Method of Making Panels

Exemplary panels 100 may be constructed from composite materials, such as plastics, gypsum, inert fillers and/or polyurethane. Panel molds may be formed using methods well known in the art. Although the mold may be formed of any material, using any known technique, in certain embodiments the use of a spongy material, such as a silicon mold, may provide a more realistic surface appearance for the panel 100. Use of metal molds typically results in panels 100 with a glossy surface, that does not mimic stone, brick or other materials as well as a flat surface. Silicon, ceramic or other types of molds may be used to provide a less glossy exterior surface 105 that better mimics stone, brick, wood or other materials.

The mold may be preheated to facilitate panel 100 casting. A non-stick material may be sprayed onto the mold surface to prevent sticking of the polyurethane composite to the mold surface. The mold may be heated to dry the non-stick material before casting. The appearance of a simulated rock, simulated brick or other surface may be provided by adding materials, such as iron oxide, to the mold surface that will be in contact with the exterior surface 105 of the panel 100. The mold may be heated again to dry the surface coating material. Additional layers of material, such as a UV blocking agent, may also be applied to the mold surface that will contact the exterior surface 105 of the panel 100. When the polyurethane or other composite is poured into the mold, the materials coating the mold will adhere to the panel 100 and become incorporated into the panel surface. The mold may be placed into a mold shell and polyurethane or other composite may be poured or injected into the closed mold. Alternatively, polyurethane may be poured into an open mold and the mold then closed. Where a thermosetting type of material is used, the mold may be heated to facilitate curing of the panel 100. The rough shaped panel 100 may be removed from the mold and set aside for a period of time, for example 24 hours on a flat surface, to cure the polyurethane or other composite. The cured panel 100 may be cut to proper height and any imperfections left from the casting process may be removed.

The angled contact surface between the upper 110 and lower 120 interlocking members may be provided either by casting the panel 100 with the contact angle already formed, or alternatively by forming angled surfaces on the upper 110 and lower 120 interlocking members after the panel 100 has been cast. In an exemplary embodiment of the latter technique, once the panel 100 has been roughed out, an angled "V" shaped groove is formed into the lower recessed lip on the bottom frame area of the panel 100. The portion of the V-shaped groove that will be in contact with the building wall or other surface is parallel to the vertical back line of the panel 100 (i.e., the interior surface 115) and is provided by the casting process. The portion of the V-shaped groove that faces away from the wall is cut at an angle of between 22.5 degrees and 77.5 degrees, for example, about 45 degrees, to the interior surface 115 of the panel 100. Although a variety of methods may be used to cut the angle, in preferred embodiments a router bit is shaped to provide the appropriate angle and the groove is cut by running the panel 100 through a router table or manually running a router along the edge of the panel 100. The contact angle on modified tongue (upper interlocking member 110) of the panel 100 may be shaped to correspond with the opposite V angle of the lower interlocking member 120 of the panel 100, so that the two will fit snugly together when upper and lower panels 100 are assembled. In a non-limiting embodiment, the panel 100 may be placed into a panel carriage to hold the panel in place while the angles are cut on the upper 110 and lower 120 interlocking members. Either a different carriage may be used to cut the angles on the upper 110 and lower 120 interlocking members, or a single carriage may be used to pass the panel 100 through a dual bit routing station.

As discussed above, the angle surface on the upper interlocking member 110 may be cast with the rest of the panel 100 or may preferably be added at a later stage, for example using an appropriately shaped router bit. The skilled artisan will realize that in order to have a snug fit, the angles on the upper 110 and lower 120 interlocking members should be complementary. For example, when the angle on the lower member 120 is 45 degrees, the angle on the upper member should also be 45 degrees. Where the angle on the lower member 120 is, for example, 30 degrees, the angle on the upper member 110 should be (90 minus 30=) 60 degrees, and so forth. As discussed above, when the upper 110 and lower 120 members are interlocked, the bottom edge of the panel to will partially or totally cover the nail hem (modified tongue) while the intersecting angles of the upper 110 and lower 120 interlocking members act to lock the bottom of the panel 100 against the wall.

The skilled artisan will realize that different techniques may be used to provide an exterior surface 105 that mimics stone, brick or other materials. As discussed above, a surface coating incorporating iron oxide, sand, powdered rock or other material may be incorporated into the panel 100 during a molding process. Alternatively, various paint materials, such as polyurethane based paints are known that may be coated onto the panel 100 after panel formation.

Example 2

Panels Comprised of Two or More Different Layers

In some embodiments the panels 100 may be comprised of a substantially homogeneous material, such as polyurethane. A composite material, such as polyurethane with embedded fibers, may still be considered substantially homogeneous, so long as the composition does not differ substantially throughout the panel 100. Such a homogeneous panel 100 may be surface coated with other materials, such as iron oxide, paint and/or a UV protective layer, as disclosed above.

In an alternative embodiment, the panel 100 may be comprised of two or more different layers made up of different materials. For example, a layer of a material, such as polyurethane, of about 1 cm in thickness may be used to form the exterior surface 105 of a panel 100. The exterior surface may be coated with or otherwise incorporate various materials, such as a UV blocking agent, iron oxide, paint, or other substances to enhance the appearance, durability, resistance to flammability or other properties of the panel 100. The interior surface 115 of the panel 100 may be comprised of a different type of material, such as fiberglass, vinyl, polystyrene, thermal plastic, polyester, styrofoam, polyvinyl chloride, vinyl acetate, gypsum, a composite of gypsum and polyurethane, acrylic material or any other material known in the art for construction of panels 100. In some embodiments, the material used to form the layer of the panel 100 comprising the interior surface may be selected for characteristics such as the cost of raw materials, flexibility, rigidity, fire resistance, resistance to mold, fungus or rot, weight, structural strength, durability, resistance to impact, stability, thermal insulation or any other characteristics of interest for building materials and/or siding.

A variety of techniques may be used to produce a panel 100 comprised of two or more different layers. For example, the layer used to form the interior surface 115 may be formed by injection molding or any other known method and then coated with a flexible composite, such as polyurethane. The exterior surface layer may be formed by spraying material onto the backing, by inserting the backing into a mold and providing the exterior surface layer by injection molding, by pouring, spraying or otherwise layering the material used to form the exterior surface 105 into a mold and then inserting the interior surface layer, or any other technique known in the art for forming a multi-layered panel. The skilled artisan will realize that the order in which the layers are formed may vary. In different embodiments, the layer forming the exterior surface 105 may be formed first or alternatively the layer forming the interior surface 115 may be formed first.

All of the SYSTEMS, COMPOSITIONS and METHODS disclosed and claimed herein can be made and executed without undue experimentation in light of the present disclosure. While the systems, compositions and methods of this invention have been described in terms of preferred embodiments, it will be apparent to those of skill in the art that variations may be applied to the SYSTEMS, COMPOSITIONS and METHODS and in the steps or in the sequence of steps of the methods described herein without departing from the concept, spirit and scope of the invention. More specifically, it will be apparent that certain agents that are both chemically and functionally related may be substituted for the agents described herein while the same or similar results would be achieved. All such similar substitutes and modifications apparent to those skilled in the art are deemed to be within the spirit, scope and concept of the invention as defined by the appended claims.

What is claimed is:

1. A system for attaching panels to a vertical building surface comprising:

a) one or more panels, each panel with an exterior surface and a back surface, the exterior surface adapted to face away from a vertical building surface to which the panel is attached, and the back surface adapted to face toward the vertical building surface;

b) an upper interlocking member at the upper end of each panel;

c) a lower interlocking member at the lower end of each panel;

d) a side interlocking member at each side of each panel;

e) weep channels recessed within the back surface of each panel to allow for water drainage; and f) air chambers recessed within the back surface of each panel to allow for air circulation, wherein the contact between the upper and lower interlocking members of vertically adjacent panels forms a modified tongue and groove joint, with a contact angle of between 22.5 and 77.5 degrees and the angled surface of the upper interlocking member is oriented towards the vertical building surface, wherein the air chambers are larger than the weep channels, and wherein at least one of the weep channels vertically connects at least two of the air chambers.

2. The system of claim 1, wherein the contact angle is about 45 degrees.

3. The system of claim 1, further comprising screw attachment strips on each upper interlocking member.

4. The system of claim 1, further comprising one or more ledgers attached to the upper interlocking members of one or more panels.

5. The system of claim 1, further comprising one or more corners attached to the side interlocking members of one or more panels.

6. The system of claim 1, wherein the weep channels and air chambers form a contiguous pathway for air circulation and water drainage.

7. The system of claim 1, further comprising screws, nails or other attachment devices attaching the panels to the vertical building surface.

8. The system of claim 7, wherein the vertical building surface is a wall.

9. The system of claim 8, wherein the upper and lower interlocking members are designed to press the panels against the wall when the upper and lower interlocking members are engaged.

10. The system of claim 7, wherein the locations of the attachment devices are hidden from external view when the panels are assembled.

11. The system of claim 1, wherein the panels are homogeneous in composition.

12. The system of claim 1, wherein the panels are comprised of two or more layers.

13. The system of claim 12, wherein the different layers are comprised of different materials.

14. The system of claim 1, wherein the side interlocking members form a ship lap joint.

15. The system of claim 1, wherein a shape of each of the air chambers recessed within the back surface of each panel corresponds to a simulated building material element on the exterior surface.

16. The system of claim 15, wherein the simulated building material element is a simulated rock.

17. The system of claim 15, wherein the simulated building material element is a simulated block.

18. A method for attaching paneling to a vertical building surface comprising:

a) obtaining one or more panels, each panel with an exterior surface, a back surface, upper and lower interlocking members and two side interlocking members, the exterior surface adapted to face away from a vertical building surface to which the panel is attached, and the back surface adapted to face toward the vertical building surface;

b) attaching the panels to a building surface in an interlocking array, wherein the upper and lower interlocking members of vertically contiguous panels form a modified tongue and groove joint, with the upper and lower edges of the modified tongue and groove forming an interlocking junction disposed at an angle designed to press the array against the vertical building surface, wherein the one or more panels include weep channels and air chambers in the back surface of each panel to allow for water drainage and air circulation, wherein the air chambers are larger than the weep channels, wherein at least one of the weep channels vertically connects at least two of the air chambers, and wherein more than one air chamber is provided on the back surface of each panel in a horizontal direction and each air chamber is separated from each other air chamber in the horizontal direction.

19. The method of claim 18, wherein the angle is about 45 degrees.

20. A building panel comprising:

a) an upper interlocking member at the upper end of the panel;

b) a lower interlocking member at the lower end of the panel; and c) side interlocking members at each side of the panel;

wherein the upper and lower interlocking members are designed to form a modified tongue and groove joint between vertically contiguous panels, with a contact angle of between 22.5 and 77.5 degrees, and the angled surface of the upper interlocking member is oriented towards a vertical building surface when the panel is attached to the surface, and wherein the panel includes weep channels and air chambers in a back surface of the panel to allow for water drainage and air circulation, wherein the back surface is configured for placement against the vertical building surface, wherein the air chambers are larger than the weep channels, wherein at least one of the weep channels vertically connects at least two of the air chambers, and wherein water passing through a first weep channel is isolated from water passing through a second weep channel located in a horizontal direction from the first weep channel.

21. The panel of claim 20, wherein the contact angle is about 45 degrees.

* * * * *